United States Patent [19]

Sunaga

[11] Patent Number: 4,807,446

[45] Date of Patent: Feb. 28, 1989

[54] AIR OUTLET NOZZLES FOR AN AIR CIRCULATION DEVICE IN A REFRIGERATED DISPLAY CABINET

[75] Inventor: Mamoru Sunaga, Ota, Japan

[73] Assignee: Sanden Corporation, Gunma, Japan

[21] Appl. No.: 7,272

[22] Filed: Jan. 27, 1987

[30] Foreign Application Priority Data

Jan. 24, 1986 [JP] Japan ..... 61-8780[U]
Mar. 12, 1986 [JP] Japan ..... 61-35455[U]
Mar. 15, 1986 [JP] Japan ..... 61-37763[U]

[51] Int. Cl.[4] ..... A47F 3/04
[52] U.S. Cl. ..... 62/256; 62/298
[58] Field of Search ..... 62/256, 298, 413, 414; 98/36, 40.18; 239/602, 600, 568, 554, 555, 553.5, 557, 560

[56] References Cited

U.S. PATENT DOCUMENTS 3,203,337 8/1965 Beckwith ..... 98/36
3,279,883 10/1966 Thompson et al. ..... 98/36 X
3,291,027 12/1966 Beckwith ..... 62/256 X

FOREIGN PATENT DOCUMENTS 448482 2/1913 France ..... 239/555

*Primary Examiner*—Harry B. Tanner
*Attorney, Agent, or Firm*—Banner, Birch, McKie & Beckett

[57] ABSTRACT

A refrigerated display case having an improved air outlet nozzle is disclosed. The display case includes an insulated enclosure having an access opening in the front and means for establishing an air curtain across the opening from an upper air outlet to a lower air inlet. A nozzle structure is removably disposed on the discharge opening to define the air stream layer. The nozzle is formed as a gridlike honeycomb section having a plurality of flat tube elements each of which are stacked against each other and bound together through a removable fastening device. This facilitates maintenance of the nozzle. The flat tube elements may also be formed having air passageways of progressively differing cross sectional areas to decrease turbulance between the air stream and adjacent ambient air.

28 Claims, 4 Drawing Sheets

AIR OUTLET NOZZLES FOR AN AIR CIRCULATION DEVICE IN A REFRIGERATED DISPLAY CABINET

TECHNICAL FIELD

The present invention relates to improved air circulation devices for refrigerated display cabinets. More particularly, the present invention relates to an air nozzle construction for use in an air circulation device of a refrigerated display cabinet having two or more air curtains moving in a side-by-side relationship.

BACKGROUND OF THE INVENTION

In refrigerated display cabinets which are provided with an access opening at the front side, air curtains are moved across the access opening of the cabinet to retain refrigeration. The characteristics of the air curtains are important to the efficient operation of the air circulation device. Such refrigerated display cabinets are well known and described in U.S. Pat. Nos. 3,134,243 and 2,862,369.

As disclosed in the above patents, the refrigerated display cabinet has a relatively large access opening exposed to the atmosphere yet must maintain its contents in a refrigerated state. The loss of refrigeration from the enclosed space through the access opening is reduced effectively by an air circulation device using a gaseous (preferably air) curtain which is continuously moved across the access opening from one edge to the opposite edge. The air curtain is formed by adjacent stream layers of air. The innermost stream layer is a refrigerated cold air stream; one or more outer stream layers or guard stream layers have temperatures approaching the ambient temperature. It is desirable to circulate the inner cold air stream and to circulate the adjacent guard stream layers to conserve the refrigeration and to maintain the enclosed space in a satisfactorily refrigerated state.

In these constructions of air circulating devices, assemblies including nozzles extend across the upper edge of the access opening and direct the air stream layer downwardly across the opening toward inlets which extend across the bottom edge of the access opening. Conventional air circulation devices use various methods to form the nozzle. Honeycomb materials have been used in the construction of such nozzles, since the plurality of air passages in the honeycomb create desirable flow characteristics. Honeycomb sections distribute the air in a more uniform fashion across the width of a nozzle. Such uniformity is desirable since it greatly reduces a tendency toward turbulence of the laminar air flow.

The honeycomb sections are normally assembled either as a plurality of plate elements or as a flat tube element having a plurality of air passageways therein. The former structure is complicated to assemble; many plate elements face each other with a gap and are bound by support elements on the outlet portion of the air circulation path. The latter structure is disclosed in Japanese Patent Publication No. 57-38253 in which a plurality of pairs of notched or scored lines are formed on opposite sides of a single flat tube. The lines are perpendicular to air passageways formed in the flat tube. The tube is bent along the notched lines and folded accordian style to form a honeycomb grid of a plurality of air passageways. However, because the honeycomb is formed by one flat tube, if the honeycomb is partially damaged during, e.g., the cleaning or replacing operations, the entire nozzle portion must be replaced.

Furthermore, turbulence-induced refrigeration losses impede the effectiveness of air curtains. Refrigeration losses can be attributed, to a substantial degree, to turbulence between moving air streams and adjacent still air. Specifically, the movement of a stream of air adjacent still air or adjacent another stream moving at a substantially different speed creates turbulence. The moving streams of air affected by turbulence periodically leave their intended paths causing large masses of the air to be removed and be unrecoverably lost from the circulating streams. Where these air masses are refrigerated, the load on the refrigerating means for the cabinet increases.

Moreover, the nozzle tube elements are normally formed of a synthetic resin, such as polyethylene or polypropylene, and each passageway is formed having a rectangular cross section with partition walls extending perpendicularly between two side surfaces of the tube elements. This renders the honeycomb section easily damagable from impacts with cleaning devices and during assembly and reassembly operations; impact forces against one side surface and directly transferred to the opposite side surface through the partition walls.

SUMMARY OF THE INVENTION

It is a primary object of this invention to provide an improved air outlet nozzle structure for an air circulation device in a refrigerated display cabinet that is simple to operate and has low maintenance costs.

It is another object of this invention to provide an air outlet nozzle structure for an air circulation device in a refrigerated display cabinet having increased efficiency while having a simple construction.

A refrigerated display cabinet according to the present invention has a display space, an access opening in the front of the display space, and a series of devices for establishing an air curtain across the access opening. The devices for establishing the air curtain include an air duct communicating with an air inlet located adjacent the lower edge of the access opening. The duct has an upper air discharge outlet near the upper edge of the access opening. A blower for circulating air through the duct and an evaporator for refrigerating the air circulated through the duct are disposed in the duct. A nozzle device is disposed on the discharge opening of the duct to define the air curtain. The nozzle device comprises a plurality of flat tubes, each of which is provided with a plurality of air passageways. The flat tubes are bound to each other by a removable fastening element to form a gridlike honeycomb section. The bound flat tubes are removably held on the air discharge opening of the duct through supporting elements. The honeycomb section is easy to maintain as the flat tubes may be individually removed for servicing.

Another aspect of the present invention addresses the problem of turbulence caused by the difference in speeds between the air streams and the adjacent ambient air. This problem is solved by varying the cross sectional areas of the air passageways of adjacent flat tubes to reduce the air stream speed at the ends of the nozzle. The areas of the air passageways adjacent the ambient air are reduced. The speeds of the air streams adjacent the ambient air are therefore lower, and the difference in speed between the air streams and the adjacent ambient air is lower. This reduces turbulence.

A further aspect of the present invention involves configuring the partition walls of the flat tubes to absorb inadvertant impact forces when the flat tubes are formed from synthetic resins.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

FIGS. *6a–6d* are diagramatic sectional views of various configurations of the flat tube of the nozzle according to further modifications of the present invention.

FIGS. *7a* and *7b* illustrate the scoring and folding of flat tubes to form a double line of passageways.

DETAILED DESCRIPTION OF PREFERRED EMBODIMENTS

Figure 1:
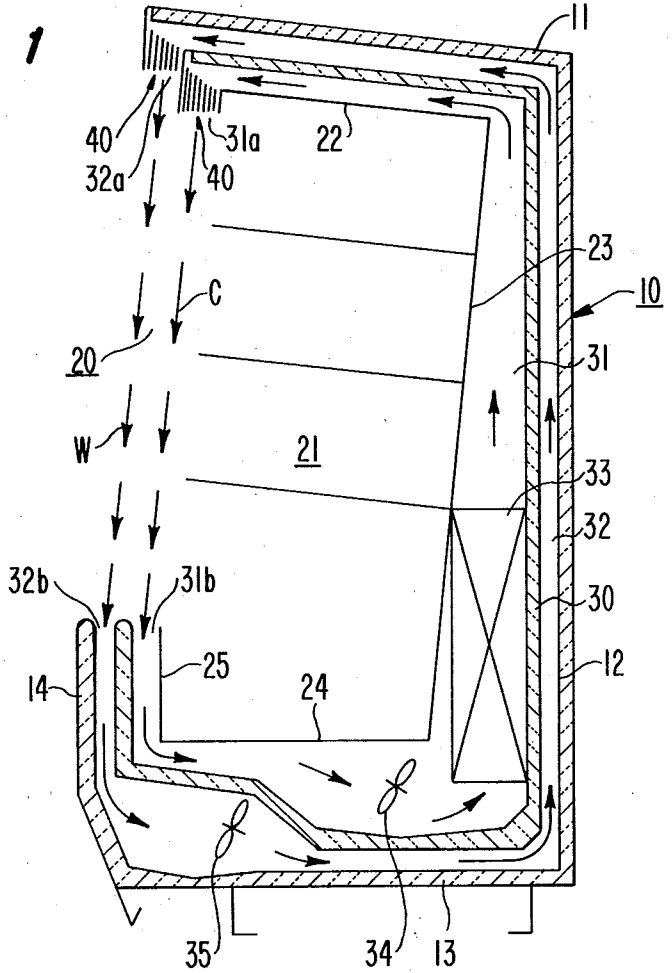
FIG. 1 is a vertical sectional view of a refrigerated display cabinet illustrating the general structure of the cabinet according to the present invention.

As shown in FIG. 1, the general structure of refrigerated display cabinet 10 has top wall 11, back wall 12, bottom wall 13, side walls (not shown), and front wall 14. Front wall 14 is formed with access opening 20 communicating between enclosed space 21 within cabinet 10 and the outside atmosphere.

Spaced inwardly from the housing walls and in a substantially parallel relationship therewith are inner walls including top inner wall 22, back inner wall 23, bottom inner wall 24, side inner walls (not shown), and front inner wall 25, all of which together define enclosed space 21. The space between the inner walls and outer walls is subdivided by partition wall 30 to define two separate passageways, inner passageway 31 and outer pasasgeway 32. More than two passageways may be used if desired. The passageways extend around enclosed space 21 from inner outlet 31*a* and outer outlet 32*a* located across the upper edge of the access opening 20 to inner inlet 31*b* and outer inlet 32*b* located across the opposite bottom edge of opening 20, respectively.

Inner passaway 31 is provided with evaporator 33 through which refrigerant is circulated for indirect heat exchange with air travelling through inner passageway 31. Located between evaporator 33 and inlet 31*b* is an air circulating means such as inner fan or blower 34 which includes the flow of a stream of cold air through inner passageway 31 from inner inlet 31*b* through evaporator 33 to inner outlet 31*a* and across access opening 20 to inner inlet 31*b*. Also, another air circulating means such as outer fan or blower 35 is located within outer passageway 32 for inducing the flow of a guard air stream through outer passageway 32 from outer inlet 32*b* to outer outlet 32*a* and across opening 20 to outer inlet 32*b*.

The circulation of one or more guard air streams in combination with the cold or conditioned air stream to form an air curtain extending across the access opening enhances the laminar flow characteristics of the air stream layers and minimizes the amount of intermixing of ambient air in the cold air stream layer.

The display cabinet provides an inner cold air stream layer C and an outer warm air stream layer W having a temperature intermediate that of the cold air stream layer and the ambient air. The outer warm air stream layer is the guard air stream layer and shields the cold air from the heat of the atmosphere and minimizes the loss of cold air into atmosphere. Air from the guard air stream layer mixed into the cold air stream layer will be at a considerably lower temperature than the air from the atmosphere which otherwise would be admixed.

Inner and outer outlets 31*a*, 32*a* of inner and outer passageways 31, 32, respectively, include nozzle 40 having a vane or honeycomb section which extends continuously across the top side of access opening 20 in front wall 14 of cabinet 10 to define each air stream layer.

Figure 2:
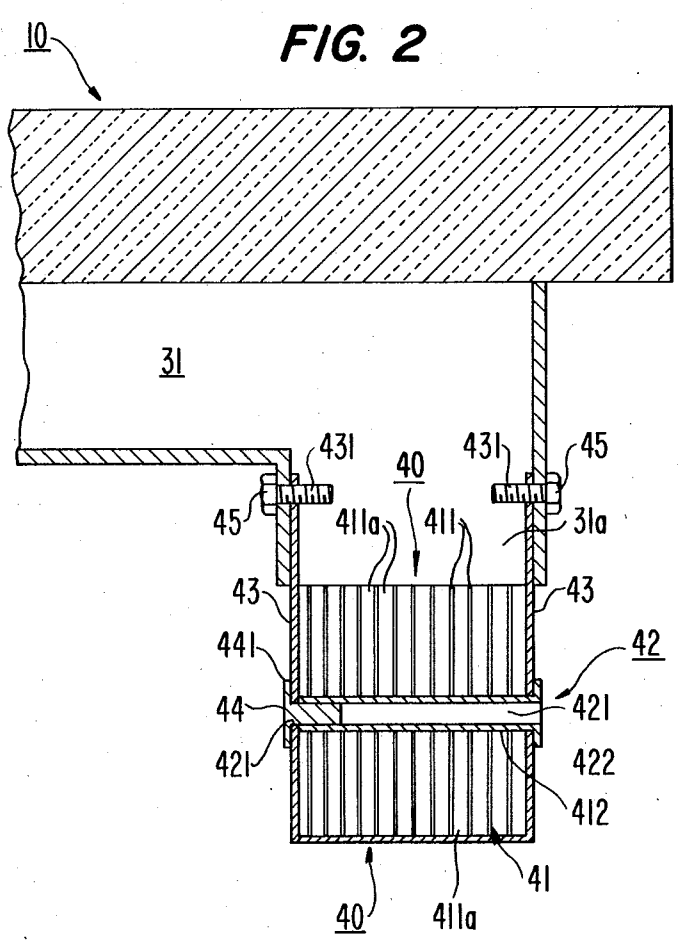
FIG. 2 is an enlarged sectional view of a nozzle according to the present invention.
Figure 3:
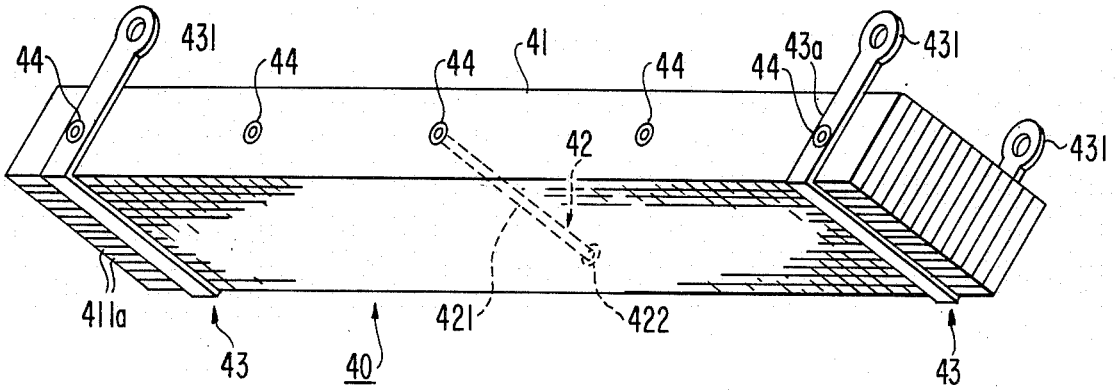
FIG. 3 is a perspective view of the flat tubes used in the nozzle of FIG. 2.
Figure 4:
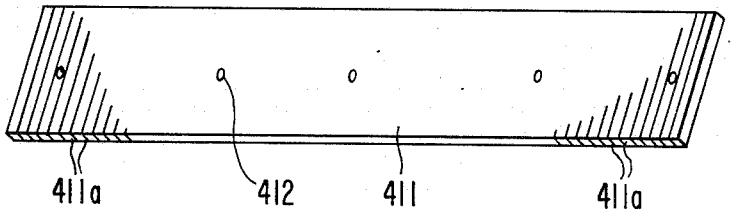
FIG. 4 is a perspective view of one of the flat tubes shown in FIG. 3.

Referring to FIGS. 2 and 3, nozzle 40 includes honeycomb element 41 having a plurality of flat tubes 411, holding device 42 which binds flat tubes 411 to form honeycomb element 41, and supporting device 43 which supports honeycomb element 41 in the respective outlets 31*a*, 32*a* of passageawys 31, 32. Nozzle 40 of inner passageway 31 is shown for illustrative purposes. Flat tubes 411 are provided with a plurality of air passgeways 411*a* and are mounted together to form honeycomb element 41. A plurality of penetration holes 412 are formed through each tube 411 to house holding device 42. Holding device 42 includes tubular element 421 having flange portion 422 at one end and fastening element 44 removably fastened at its other end. Fastening element 44 includes large portion 441. Flange portions 42, 441 are fitted against the outermost positioned flat tube 411 to restrict the movement of flat tubes 411. Supporting device 43 has a U-shaped cross section and is fixed around honeycomb element 41. Supporting device 43 has holes 43*a* to allow placement of holding device 42. The outer terminal end portions of supporting device 43 are formed having threaded hole 431. Supporting device 43 is fixed on the outlet portion of front wall 14 through bolts 45 screwed through threaded hole 431.

Preferably, in their formation, each flat tube 411 is formed of a longer flat tube that is notched or scored along a center line perpendicular to air passageways 411*a*, as shown on FIG. *7a*. Flat tubes 411 are folded along the scored center line to form two rows of air passageways 411*a*, as shown in FIG. *7b*. A plurality of these double-rowed flat tubes 411 are fastened together to form honeycomb element 41. Honeycomb element 41 is placed on outlet openings 31*a*, 32*a*, and is held in position by bolts 45. Each flat tube 411 may be easily and individually replaced without replacing the entire nozzle.

Another aspect of the present invention controls turbulence losses due to the difference in air speeds between the air stream and the adjacent ambient air. These turbulence losses can be controlled by controlling the air stream speeds. If air streams contact each other with smaller speed differences turbulence is reduced. Thus, if the portion of the air stream which contacts the relatively still ambient air moves at a slower speed than other portions of the stream, turbulence is reduced. This also applies to the air stream which contacts the still air within the display case. To vary the air stream speeds, the cross sectional area of the air passageway 411*a* of adjacent flat tubes 411 is varied. The area is larger in flat tubes 411 toward the center of honeycomb element 41, and the area is smaller toward the outside of honeycomb element 41.

Figure 5:
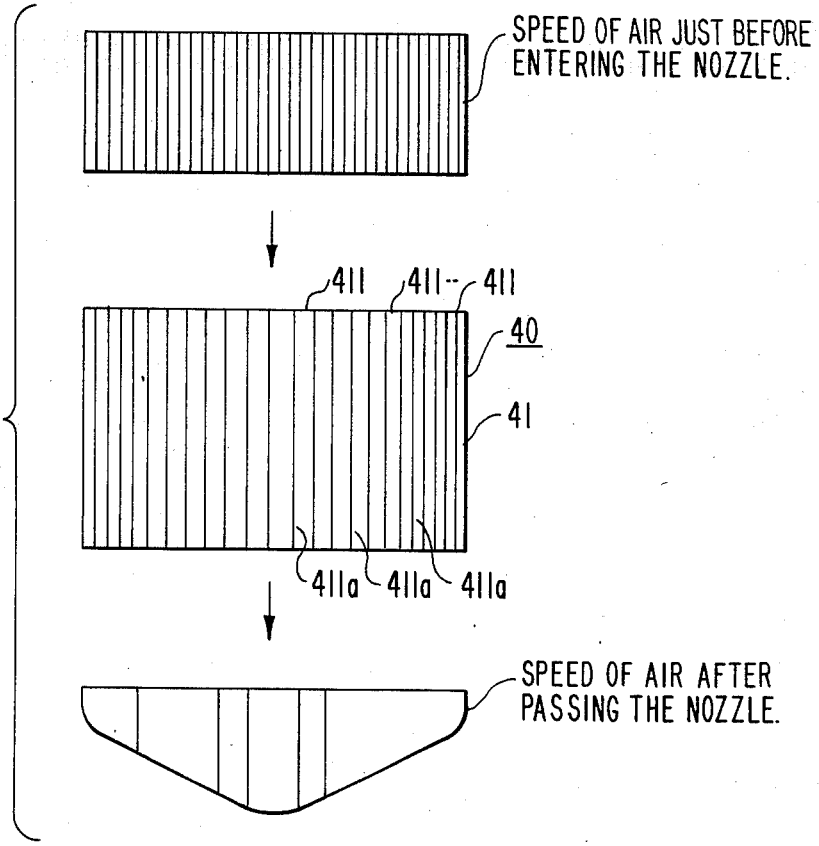
FIG. 5 is a diagramatic view of the nozzle graphically illustrating the various speeds of the air stream before and after passing through the nozzle according to a further modification of the present invention.

FIG. 5 illustrates, in the center segment, a view of flat tubes 411 of honeycomb element 41 of nozzle 40 similar to that of FIG. 2. In FIG. 5, the cross sectional areas are smaller toward the outside of honeycomb element 41. The upper and lower portions of FIG. 5 graphically illustrate the difference in speed between the air stream entering honeycomb element 41 (upper portion) and the air stream leaving honeycomb element 41 (lower portion). As it enters nozzle 40, the air stream is traveling at a uniform speed. As it leaves nozzle 40, the air stream has a varied speed. It is slower at the outside portions near the edge of nozzle 40 than toward the center and the magnitude of any turbulence is reduced.

Figures 6A, 6B, 6C, 6D:
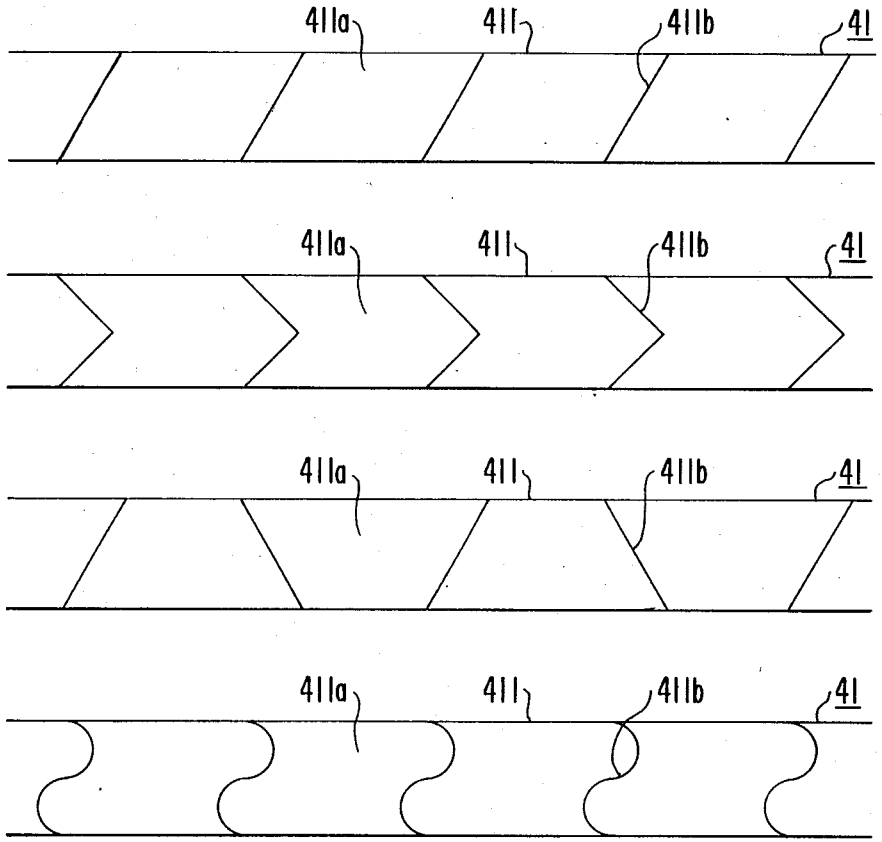
Figure 7A:
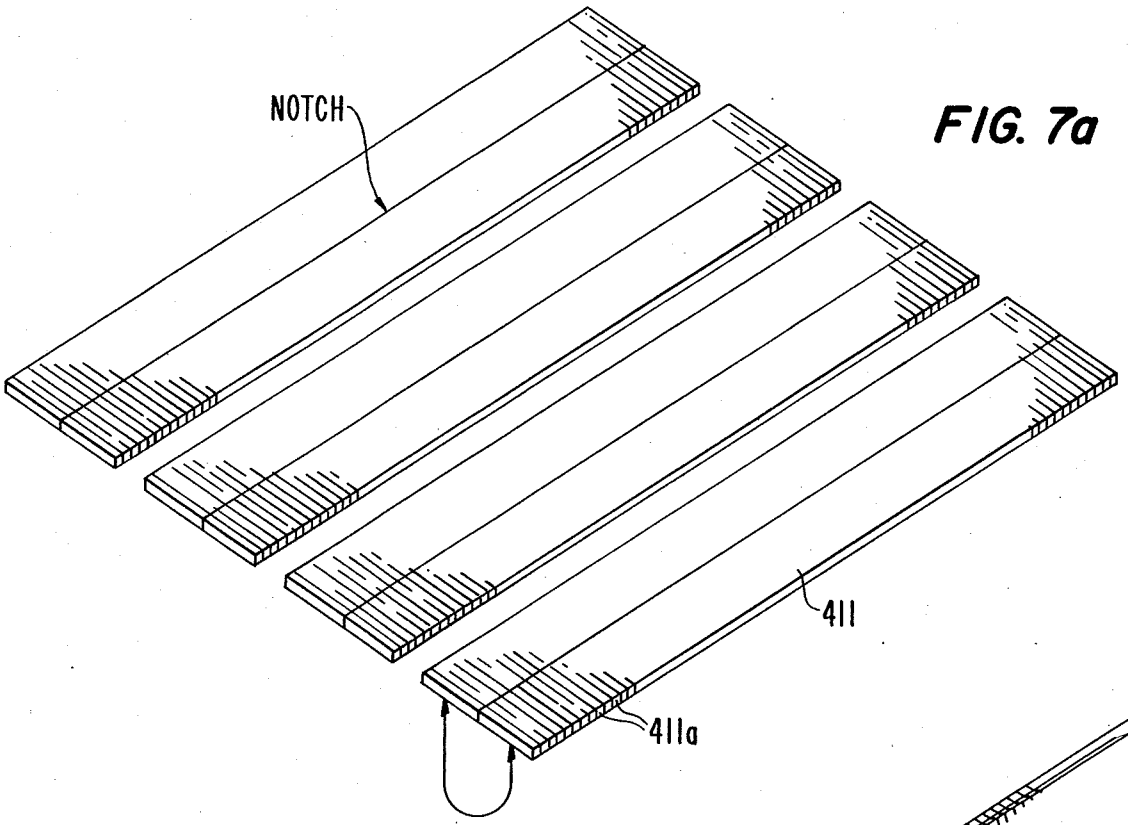
Figure 7B:
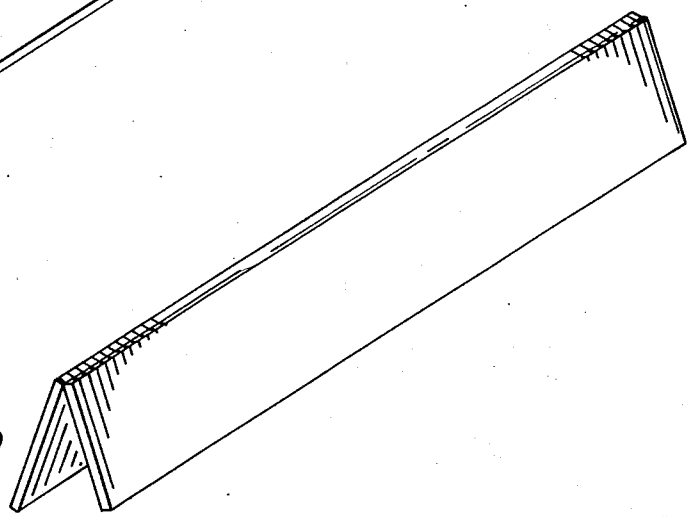

Also, if flat tube 411 is made of synthetic resin, partition walls 411*b* of flat tube 411 should be formed to absorb any impacts against the side portion of flat tube 411 from cleaning devices or from the display case during disassembly and reassembly. To accomplish this, the cross section of partition wall 411*b* should be formed as shown in FIG. 6. This reduces the chances of damaging flat tube 411 or honeycomb element 41. Since synthetic resin is generally elastic, partition walls 411*b* are formed at an inclined angle with the side portions of flat tube 411. The elasticity enables partition walls 411*b* to deform under impact forces and absorb the forces, thereby protecting flat tubes 411 from damage. The configurations shown in FIGS. 6*a*–6*d* are illustrative examples only. FIG. 6*a* illustrates a nonrectangular parallelogram configuration; FIG. 6*b* illustrates a V-shaped configuration; FIG. 6*c* illustrates a trapezoidal configuration; and FIG. 6*d* illustrates a sigmoidal configuration. Other partition wall 411*b* configurations could also be employed.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be affected therein by one skilled in the art without departing from the scope or spirit of the invention. For example, the described nozzles may be employed with circulation devices used in systems other than refrigerated display cabinets.

I claim:

1. In a refrigerant display cabinet comprising a display space, an access opening in the front of said display space, air curtain means for establishing an air curtain across said access opening, said air curtain means comprising an air inlet located adjacent the lower edge of said access opening, an air duct communicating with said air inlet having an air discharge outlet near the upper edge of said access opening, a nozzle device disposed on said air discharge opening to define the air curtain, circulating means for circulating air through said air duct and refrigeration means for refrigerating the air curtain, the improvement comprising:

said nozzle device comprising a plurality of flat tubes having a plurality of air passageways, said plurality of flat tubes being separately and individually removable and replaceable, a removable fastening element binding said flat tubes to each other to form a honeycomb section, and supporting elements removably holding said flat tubes on said air discharge outlet of said duct, said fastening element and said supporting elements being removable and replaceable to facilitate individual removal and replacement of said flat tubes.

2. The refrigerated display cabinet of claim 1, wherein said removable fastening element comprises an elongate member which extends through said flat tubes, having a radial flange portion at a first end and a retaining element having a removably connected radial flange portion on a second end.

3. The refrigerated display cabinet of claim 1, wherein the cross sectional area of said air passageways in adjacent said flat tubes differs progressively to decrease the speed of the air curtain away from the center portion of said nozzle device.

4. The refrigerated display cabinet of claim 3, wherein the cross sectional area of said air passageways in adjacent said flat tubes decreases away from the center portion of said nozzle device.

5. The refrigerated display cabinet of claim 1, wherein said flat tubes are separately formed.

6. The refrigerated display cabinet of claim 1, wherein said flat tubes are formed from longer flat tubes, said longer flat tubes being scored along a center line across and perpendicular to said plurality of air passageways and folded along said scored center line to form a double line of said air passageways.

7. The refrigerated display cabinet of claim 1, wherein said air passsageways of said flat tubes are formed by a plurality of partition walls, said partition walls being formed to elastically absorb impact forces acting against said flat tubes.

8. The refrigerated display cabinet of claim 7 wherein said partition walls have a straight cross section and the cross sectional area of said air passageways is a nonrectangular parallelogram.

9. The refrigerated display cabinet of claim 7 wherein said partition walls have a V-shaped cross section.

10. The refrigerated display cabinet of claim 7 wherein said partition walls have a straight cross section, the cross sectional area of said air passageways is a trapezoid, and the cross sectional area of any two adjacent said air passageways is a nonrectangular parallelogram.

11. The refrigerated display cabinet of claim 7 wherein said partition walls have a sigmoidal cross section.

12. A refrigerated display cabinet comprising:

a display space;

an access opening in the front of said display space;

air curtain means for establishing an air curtain across said access opening comprising an air inlet located adjacent the lower edge of said access opening, an air duct communicating with said air inlet having an air discharge outlet near the upper edge of said access opening, a nozzle device disposed on said air discharge opening to define the air curtain comprising a plurality of flat tubes having a plurality of air passageways, said plurality of flat tubes being separately and individually removable and replaceable, a removable fastening element binding said flat tubes to each other to form a honeycomb section, supporting elements removably holding said flat tubes on said air discharge outlet of said duct, and circulating means for circulating air through said air duct, wherein said fastening element and said supporting elements are removable and replaceable to facilitate individual removal and replacement of said flat tubes; and refrigeration means for refrigerating the air curtain.

13. The refrigerated display cabinet of claim 12, wherein said removable fastening element comprises an elongate member which extends through said flat tubes and having a radial flange portion at a first end and a retaining element having a radial flange portion removably connected on a second end.

14. The refrigerated display cabinet of claim 12, wherein the cross sectional area of said air passageways in adjacent said flat tubes differs progressively to decrease the speed of the air curtain away from the center portion of said nozzle device.

15. The refrigerated display cabinet of claim 14 wherein the cross sectional area of said air passageways in adjacent said flat tubes decreases away from the center portion of said nozzle device.

16. The refrigerated display cabinet of claim 12, wherein said flat tubes are separately formed.

17. The refrigerated display cabinet of claim 12, wherein said flat tubes are formed from longer flat tubes, said longer flat tubes being scored along a center line across and perpendicular to said plurality of air passageways and folded along said scored center line to form a double line of said air passageways.

18. The refrigerated display cabinet of claim 12, wherein said air passageways of said flat tubes are formed by a plurality of partition walls, said partition walls being formed to elastically absorb impact forces acting against said flat tubes.

19. A refrigerator display cabinet comprising:

a display space;

an access opening in the front of said display space;

air curtain means for establishing an air curtain across said access opening comprising an air inlet located adjacent the lower edge of said access opening, an air duct communicating with said air inlet having an air discharge outlet near the upper edge of said access opening, a nozzle device disposed on said air discharge opening to define the air curtain comprising a plurality of flat tubes having a plurality of air passageways, said plurality of flat tubes being separately and individually removable and replaceable, a removable fastening element binding said flat tubes to each other to form a honeycomb section, wherein said removable fastening element comproses an elongate member which extends through said flat tubes and has a radial flange portion at a first end and a retaining element having a radial flange portion removably connected on a second end, supporting elements removably holding said flat tubes on said air discharge outlet of said duct, wherein said supporting elements comprise a U-shaped supporting device fixed around said plurality of flat tubes and removably fixed on said air discharge opening, and circulating means for circulating air through said air ducts, wherein said fastening element and said supporting elements are removable and replaceable to facilitate individual removal and replacement of said flat tubes; and refrigeration means for refrigerating the air curtain.

20. The refrigerated display cabinet of claim 19, wherein the cross sectional area of said air passageways in adjacent said flat tubes differs progressively to decrease the speed of the air curtain away from the center portion of said nozzle device.

21. The refrigerated display cabinet of claim 20 wherein the cross sectional area of said air passageways in adjacent said flat tubes decreases away from the center portion of said nozzle device.

22. The refrigerated display cabinet of claim 19, wherein said flat tubes are separately formed.

23. The refrigerated display cabinet of claim 19, wherein said flat tubes are formed from longer flat tubes, said longer flat tubes being scored along a center line across and perpendicular to said plurality of air passageways and folded along said scored center line to form a double line of said air passageways.

24. The refrigerated display cabinet of claim 19, wherein said air passageways of said flat tubes are formed by a plurality of partition walls, said partition walls being formed to elastically absorb impact forces acting against said flat tubes.

25. The refrigerated display cabinet of claim 24 wherein said partition walls have a straight cross section and the cross sectional area of said air passageways is a nonrectangular parallelogram.

26. The refrigerated display cabinet of claim 24 wherein said partition walls have a V-shaped cross section.

27. The refrigerated display cabinet of claim 24 wherein said partition walls have a straight cross section, the cross sectional area of said air passageways is a trapezoid, and the cross sectional area of any two adjacent said air passageways is a nonrectangular parallelogram.

28. The refrigerated display cabinet of claim 24 wherein said partition walls have a sigmoidal cross section.

* * * * *